US005609007A

United States Patent [19]

Eichner

[11] Patent Number: 5,609,007

[45] Date of Patent: Mar. 11, 1997

[54] INTEGRATED REFACING SYSTEM FOR SUSPENDED CEILINGS

[76] Inventor: Vincent T. Eichner, R.D. 2, Box 196, Chester, N.Y. 10918

[21] Appl. No.: 383,874

[22] Filed: Feb. 6, 1995

[51] Int. Cl.[6] ..... E04B 1/00

[52] U.S. Cl. ..... 52/747.1; 52/717.03; 52/658; 52/665; 52/506.07

[58] Field of Search ..... 52/506.07, 311.1, 52/311.3, 733.1, 730.1, 731.7, 717.03, 717.05, 717.06, 39, 658, 665, 656.9, 656.8, 314, 456, 506.06, DIG. 8

[56] References Cited

U.S. PATENT DOCUMENTS

| | | | |
|---|---|---|---|
| 3,471,981 | 10/1969 | Segil et al. | 52/506.08 X |
| 3,486,311 | 12/1969 | Allan | 52/506.08 X |
| 3,594,972 | 7/1971 | Jones et al. | 52/733.1 X |
| 4,115,970 | 9/1978 | Weinar | 52/506.07 |
| 4,569,174 | 2/1986 | Bossany | 52/712 X |
| 4,671,811 | 6/1987 | Cadwell et al. . | |
| 4,723,388 | 2/1988 | Zieg | 52/665 |
| 4,848,054 | 7/1989 | Blitzer et al. | 52/506.07 |
| 4,854,095 | 8/1989 | Michlovic | 52/311.1 X |
| 4,986,050 | 1/1991 | Brunetti et al. | 52/665 X |
| 5,265,393 | 11/1993 | Bischel et al. . | |
| 5,414,969 | 5/1995 | Krejci et al. | 52/717.03 X |

FOREIGN PATENT DOCUMENTS

| | | | |
|---|---|---|---|
| 2173227 | 10/1986 | United Kingdom | 52/506.07 |

*Primary Examiner*—Lanna Mai
*Attorney, Agent, or Firm*—Sandra M. Kotin

[57] ABSTRACT

An integrated system of components to completely reface a conventional suspended ceiling. The components are manufactured in discrete sizes and shapes to cover the grids and all grid intersections so that all installed components lie contiguously in the same plane to maintain the original appearance of the ceiling but with a fresh face. The components are designed to be snapped onto the grids using minimal upward force so as not to cause distortion or misalignment of the suspended grids. The installation can be accomplished expeditiously. The only cutting necessary is to adjust the components at the peripheral areas where the precut pieces will not fit the spaces remaining. Very little skill or special tools are required. Complementary panel cover sheets are provided to complete the refacing. The system can be constructed in a variety of colors and textures to blend with or enhance many different styles and modes of decoration. The components can be removed if another refacing is later desired.

4 Claims, 3 Drawing Sheets

INTEGRATED REFACING SYSTEM FOR SUSPENDED CEILINGS

FIELD OF THE INVENTION

The present invention relates to a total refacing system for conventional suspended ceilings. Easy snap on sections cover the lengths of all of the T-bar grids and cross grids as well as corners, intersections and peripheral grids. Thin self-adhering sheets cover the removable ceiling panels.

BACKGROUND OF THE INVENTION

Suspended ceilings are common in commercial buildings as well as in private residences. Such ceilings provide a variety of decorator finishes as well as a means to conceal an unsightly ceiling, conduits, electrical circuitry and sprinkler system supply pipes, while maintaining easy access to same.

In a suspended ceiling, a series of parallel T-bar grids is suspended from the structural ceiling by wires or other means. Perpendicular grids are joined at regularly spaced intervals and rectangular panels are placed on the flanges of the grids to complete the system. After a period of time the ceiling often becomes stained and soiled but the structural integrity of ceiling has not been compromised. This is especially true in commercial settings where industrial fumes, smoke, and other airborne particulates are deposited over time and where water leakage can cause rusting and stains. Even when a decorating change is not anticipated but only a clean look is desired, funds to replace the ceiling may not be available or it is not cost effective for the use of the premises. In residential settings a change in room decor may be desired and the suspended ceiling is not usually amenable to such changes. Painting a suspended ceiling is not easily accomplished and would not yield a satisfactory result.

There have been patents issued for a variety of ceiling systems utilizing the conventional T-bar grids. Most of these are for a particular decorator effect, primarily the three-dimensional effect of an expensive wood ceiling or an old fashioned "tin ceiling". In such cases inlaid panels are required to complete the decor. These may be practical in a smaller setting or where the cost of resurfacing is not in issue, but they do not solve the problem where larger areas are involved and cost is a major factor.

Many of the additions to the standard grid system must be installed initially with the grids and cannot be used to redecorate at a later time. These components must be installed by sliding the refacing strips over the ends of each T-bar grid before it is suspended (U.S. Pat. Nos. 3,319,389 to Levine; No. 4,722,161 to Young). A patent has isssued for a three dimensional strip that is bonded to the grids during manufacture and has a companion molded panel that gives a single construction three dimensional appearance to the finished ceiling (U.S. Pat. No. 4,189,888 to Blitzer). The ceiling of Blitzer is permanent and does not lend itself to refacing. Carved wooden moldings attached to the grids by means of special clips are taught by Anderson (U.S. Pat. Nos. 4,452,021) and Adams (U.S. Pat. No. 5,239,801).

Sanborn teaches the use of wood or wood grain beams affixed to the grids by means of hook and loop fastener strips or adhesives (U.S. Pat. No. 4,747,246). These beams also give a flamed or three dimensional appearance to the finished ceiling. Bischel et al. (U.S. Pat. No. 5,265,393) and Blitzer (U.S. Pat. No. 4,849,054) teach a three dimensional ceiling whereby beams attach to the grids to provide recessed areas in the ceiling.

None of the above systems would be practical in a commercial building where a ceiling has become dingy or damaged but the owner has no desire to invest a large sum of money in a decorator look. Weinar (U.S. Pat. Nos. 4,055,930 and 4,115,970) has developed refacing strips that are applied over the existing grids to give a fresh appearance. These strips are supported along their lengths on one side only and the strip could begin to drop or sag under its own weight or under the weight of a ceiling panel or lighting fixture resting thereon. There are no corner pieces and peripheral strips are formed by cutting the regular strips along a preformed cut line. Weinar also uses special cross caps to be applied over the intersection points to cover and conceal unsightly joints at the intersections. These caps rest on top of the strips and add another dimension or layer to the grid refacing. To cover a T-intersection the cross cap is cut along a preformed cut line.

In all of these systems the grid facing strips or beams must be cut to size before installation. This process requires time and allows for human error in cutting the strips in the exact lengths needed. This can often result in gaps or rough sections along the cut edges so that the two pieces cannot be perfectly contiguous along their entire abutments. The resulting refacing will not appear smooth and homogenous. Also, if the cuts are not perfectly perpendicular to the longitudinal edges the entire grid system can be forced out of proper alignment.

There is a need for a simple, inexpensive refacing system that can be snapped over the existing grids easily without special tools, with a minimum of on-site cutting, resulting in a smooth, planar and homogeneous appearance, and which provides refacing for the ceiling panels as well.

BRIEF SUMMARY OF THE INVENTION

The present invention provides ready cut strips, cross covers, T-covers and corner covers to be snapped over the grids of a conventional dropped ceiling to reface grids that have become damaged, rusted, stained or where a new color is desired. All of the components of the system lie in the same plane so as not to add another dimension or layer to the grids. Refacing sheets are provided for the ceiling panels. The original integrity of the ceiling remains basically the same.

It is an object of the present invention to provide a refacing system for an existing dropped ceiling that is quick and easy to install, remove or replace, and requires no special tools.

It is another object of the present invention to provide a refacing system for an existing dropped ceiling that is relatively inexpensive.

A further object of the present invention is to be able to reface the grids and the panels with complimenting colors or finishes.

Another object of the present invention is to have a series of grid refacing components to fit the various lengths and shapes needed so that, except for the peripheral areas, no cutting of the components is required.

An object of the present invention is to have grid refacing components that can be snapped onto the grids with very little force such as not to cause distortion, bending, or misalignment of the suspended grids and whereby the new components are light in weight so as not to add additional stress to the superstructure.

A still further object of the present invention is to have the components abut each other with no overlap or visible spaces between them and such that the finished system lies in a single plane.

Another object of the present invention is to provide self-adhering pre-cut sheets to easily and quickly reface the ceiling panels and which do not add appreciative weight or bulk to the panels.

A further object of the present invention is to have the grid refacing components removable so that further refacing can occur at a future time.

Other features and advantages of the invention will be seen from the following description and drawings.

DETAILED DESCRIPTION OF THE INVENTION

Figure 1:
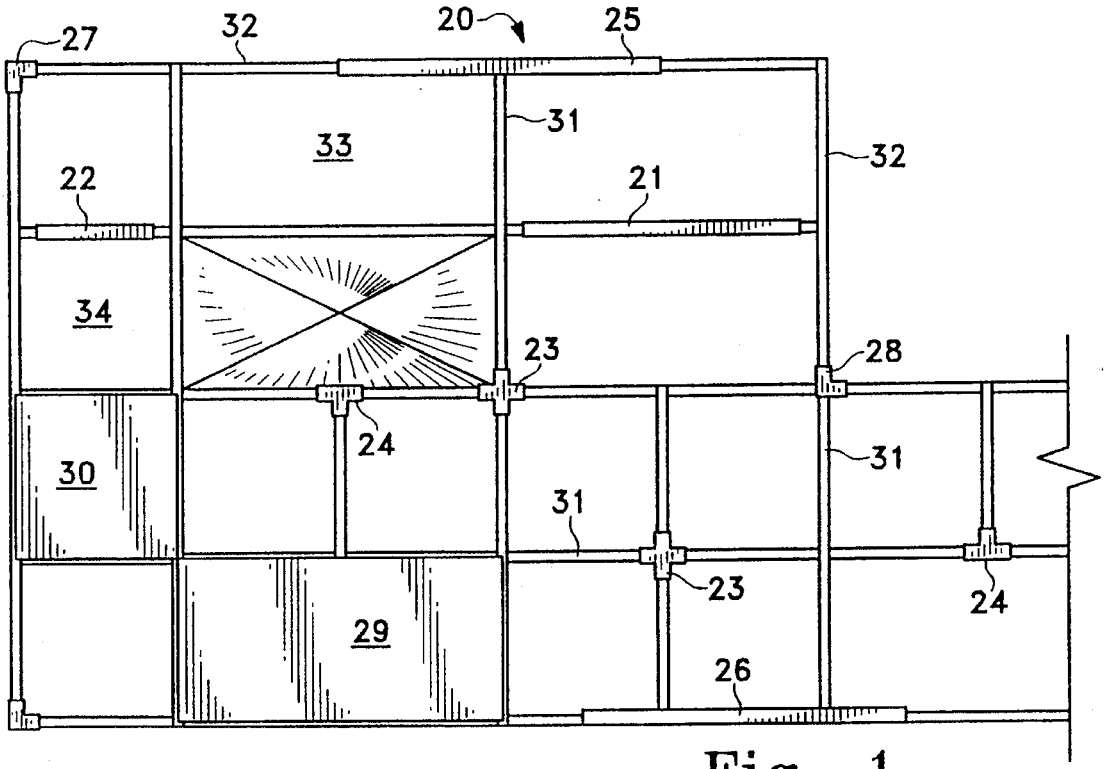
FIG. 1 is plan view looking up at a suspended ceiling and showing in outline all of the components of the instant invention.

The ceiling refacing system of the present invention consists of a series of component parts to reface the T-bar and L-bar grids of the conventional suspended ceiling and provides sheets to reface the ceiling panels so that a fresh overall surface is obtained. The present system is not designed to provide a recessed or multidimensional effect to the finished ceiling, but to put a new face on the old ceiling. When in place, all eight grid molding components are designed to lie in a single plane and to cleanly abut each other for a continuous and uniform appearance. (See FIGS. 2 and 3) The components have been designed to accommodate all possible linear and angular portions and intersections of a conventional suspended ceiling grid system. The only cutting necessary during installation is to fit the components near the corners and peripheral areas of the room. This system not only makes installation quick and easy, but results in clean and linear abutments of all components for a very finished look. The complementary self-adhering refacing sheets for the ceiling panels are quickly and easily applied to complete the refacing.

This system 20 is designed for use with the suspended ceilings that utilize 2'×4' ceiling panels 33 and 2'×2' ceiling panels 34 supported on appropriately arranged T-bar grids 31 and L-bar grids 32. The T-bar grids are suspended in longitudinal and transverse alignment and the L-bar grids are suspended about the periphery of the room. The various components of the system 20 of the instant invention are fitted over the exposed surfaces of the T-bar and L-bar grids to form a smooth, one dimensional continuous cover or new facing. These components are dimensioned to exactly fit all exposed grid areas and to lie in abutment with each other and in a single plane.

When the original suspended ceiling is erected, it is necessary to cut the grids to conform to the dimensions of the room. This neccessitates sections that are smaller than the 2'×2' or 2'×4' panels about the peripheral areas. To fit these sections the ceiling panels must be cut appropriately. The components of the system 20 are designed to fit the standard dimensions and need only be cut to fit along those peripheral areas. FIG. 1 illustrates the various components of the system 20 and the existing suspended ceiling being refaced. The components are not shown in abutment, but are properly positioned to show how each is to be utilized.

Figure 11:
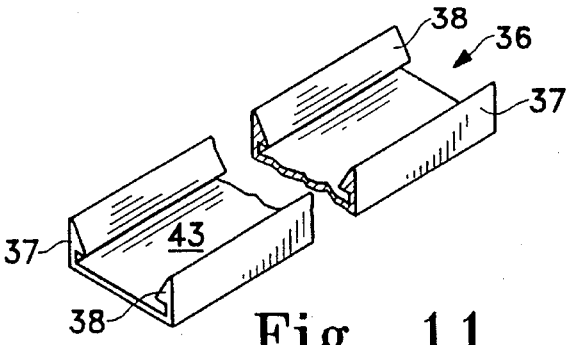
FIG. 11 is a perspective view of portions of a T-bar molding.
Figure 15A:
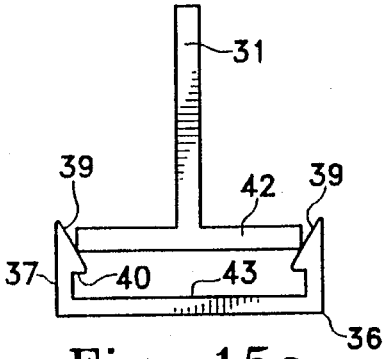
FIG. 15*a* is an end elevation of a T-bar grid and T-bar molding before installation.
Figure 15B:
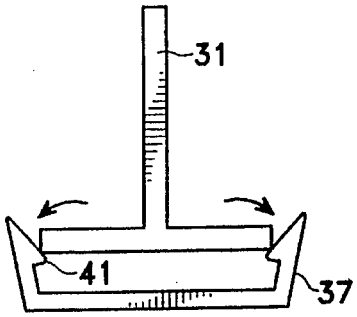
FIG. 15*b* is an end elevation of a T-bar grid and T-bar molding during installation.
Figure 15C:
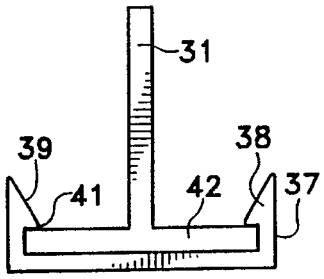
FIG. 15*c* is an end elevation of a T-bar grid and T-bar molding after installation.
Figure 15D:
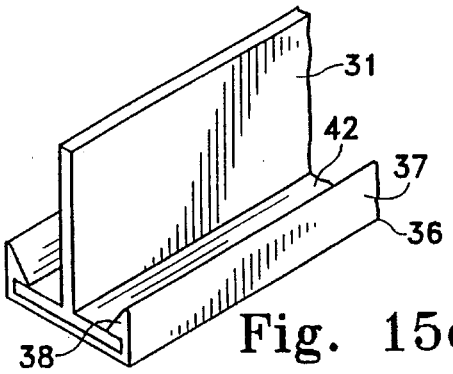
FIG. 15*d* is a perspective view of a portion of a T-bar grid and T-bar molding after installation.
Figure 16D:
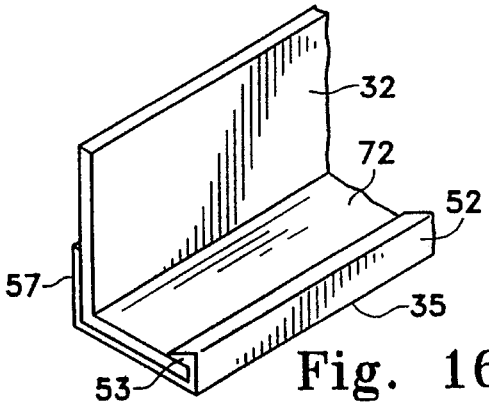
FIG. 16*d* is a perspective view of a portion of an L-bar grid and L-bar molding after installation.
Figure 16A:
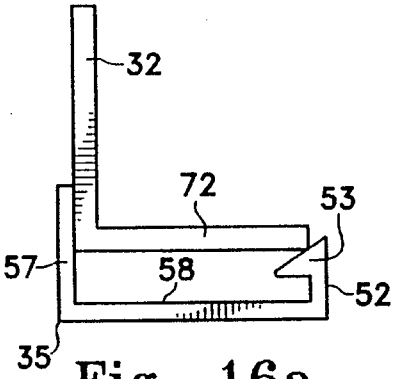
FIG. 16*a* is an end elevation of an L-bar grid and L-bar molding before installation.
Figure 16B:
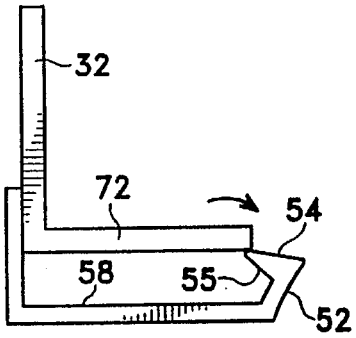
FIG. 16*b* is an end elevation of an L-bar grid and L-bar molding during installation.
Figure 16C:
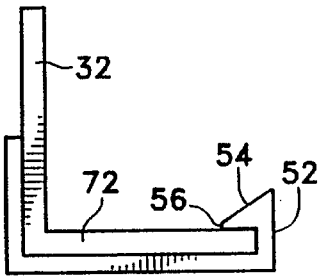
FIG. 16*c* is an end elevation of an L-bar grid and L-bar molding after installation.

The basic T-bar molding 36 is designed to be snapped on over the T-bar grids with minimal upward force so as not to cause distortion or misalignment of the suspended grids. The T-bar molding is a long strip of stiff but pliable material with a vertical wall 37 along each longitudinal edge providing, in cross-section, substantially a U-shape, to securely seat and form a snug fit about the T-bar grid 31 as in FIG. 15*c* and *d*. There are return flanges 38 on the upper edge of each vertical wall 37.(FIG. 11) The return flanges 38 extend inward and have an upward facing surface 39, a downward facing surface 40 and an inward facing edge 41. (FIG. 5) The downward facing surface 40 is horizontal and when the molding is in place it extends over the flange 42 of the T-bar grid 31 to support the molding. (FIG. 15*c*)

Figure 5:
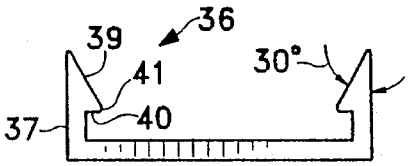
FIG. 5 is an end elevation of a T-bar molding showing the 30° angle of the upward facing surface of the return flange.

The upward facing surface 39 forms a 30° angle with the vertical wall 37 of the molding as shown in FIG. 5. This angle assists in the installation of the molding which is accomplished by holding the molding directly under the T-bar grid 31 and gently pressing it up against the grid. The angled upward facing surfaces 39 slide against the flanges 42 of the grid causing the side walls 37 to be displaced outwardly until the inward facing edges 41 of the return flanges pass the edges of the grid flanges 42 and the sidewalls 37 snap back into vertical alignment. The grid is then securely seated against the interior bottom surface 43 of the molding and the return flanges 38 extend over the grid flanges 42. This can be seen in FIGS. 15*a–d*. The smooth inclined surface helps the T-bar grid to slide into the molding smoothly without the installer having to exert too much pressure. The T-bar grids are not caused to be bent, distorted or forced out of alignment. There are two sizes of T-bar moldings, the four foot length T-bar molding 21 (actually 44.5 in.) and the two foot length T-bar molding 22 (actually 20.5 in.). These are sized to fit the necessary distances between the sites where the grids abut or intersect each other in the standard suspended ceiling with allowance for the intersection moldings. They are seen in FIG. 1.

Figure 2:
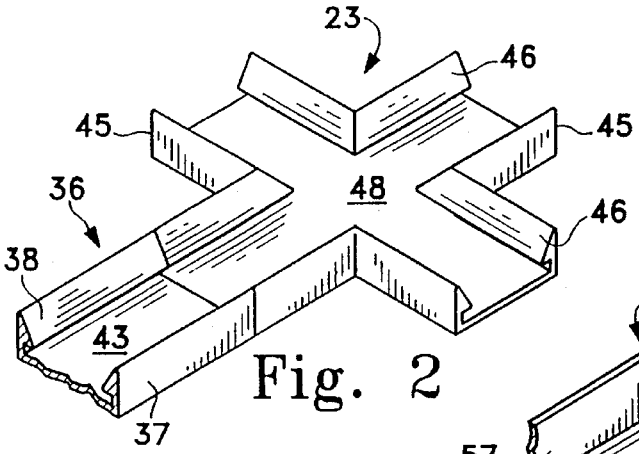
FIG. 2 is a perspective view of a T-bar molding and an adjacent cross piece molding proper alignment.
Figure 9:
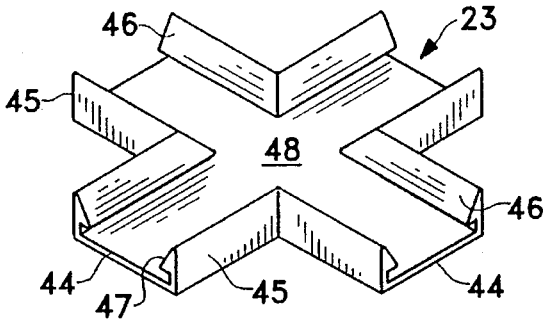
FIG. 9 is a perspective view of a cross piece molding.

To provide a smooth and uniform appearance to the completed ceiling special components are designed to cover the intersections of the T-bar grids. Where the grids cross each other cross piece moldings 23 are provided. (FIGS. 2 and 9) These are in the form of a symmetrical X having perpendicular arms 44. Each arm 44 extends 1.25 inches from the square central portion. The cross-section of each arm is the same as the cross-section of the T-bar molding 36, as seen in FIG.5, having two vertical sidewalls 45 with the return flanges 46 having upward facing surfaces 47 forming 30° angles from the vertical. The cross piece moldings are installed in the same manner, by gentle upward pressure against the intersection of the T-bar grids. Once in place, the exposed surfaces of the intersecting grids are seated securely on the interior bottom surface 48 of the cross piece molding. FIG. 2 shows a cross piece molding in contact alignment with a T-bar molding.

Figure 10:
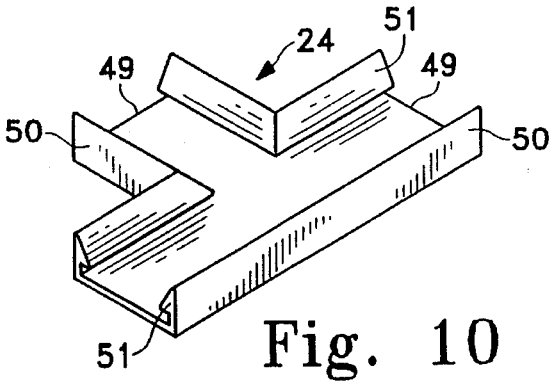
FIG. 10 is a perspective view of a T-piece molding.

In some ceiling installations one T-bar grid may abut the longitudinal edge of another to form a T joint. A T-piece molding 24 is placed over this point of abutment. The T-piece molding has a T-shaped base or a three arm T structure as seen in FIG. 10. There are vertical side walls 50 along the opposing edges of each arm 49 and return flanges 51 along the upper edge of each vertical sidewall with the same acute angle configuration as those of the cross piece moldings and the T-bar moldings. The method of installation is the same.

Figure 6:
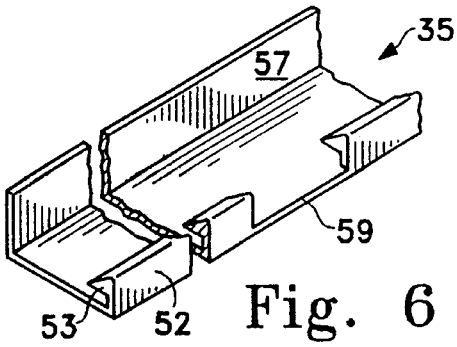
FIG. 6 is a perspective view of portions of an L-bar molding.

Around the periphery of the room L-bar grids 32 are used where the ceiling abuts the walls. L-bar moldings 35 (FIGS. 4 and 6) are designed to reface these grids. The L-bar moldings are formed in four foot lengths. Along one longitudinal edge there is a vertical wall 52 with a return flange 53. The return flange 53 has an upward facing surface 54, a horizontal downward facing surface 55 and an inward facing edge 56. The upward facing surface 54 forms a 50° angle with the vertical. See FIG. 4. The return flange 53 and downward facing surface 55 of the L-bar molding are longer than the corresponding parts of the T-bar moldings because the L-bar moldings are supported on one side only. There is a straight vertical wall 57 along the opposing longitudinal edge of the L-bar molding 35. This straight vertical wall 57 is higher than the vertical wall 52 with the return flange and it does not have a return flange. See FIGS. 3, 4, 6 and 16*a–d*.

To install the L-bar molding, it is held below the L-bar grid, the straight vertical wall 57 is slipped between the L-bar grid and the wall of the room. The L-bar grid molding 35 is pressed upward so that the flange 53 is in contact with the L-bar grid flange 72. This contact causes the flanged vertical wall 52 to be displaced outwardly until the inward facing edge 56 passes over the flange 72 of the L-bar grid. The flanged vertical wall 52 thereafter snaps back to the vertical position and the bottom of the L-bar grid is seated securely against the interior bottom 58 of the L-bar molding. See FIGS. 16*a–d*.

In a conventional suspended ceiling the T-bar grids abut L-bar grids at regularly spaced intervals around the periphery of the room. Instead of constructing an additional molding to accommodate these abutments, the L-bar moldings are made with notches 59 in the flanged vertical wall 52. (FIG. 6) These notches are the width of a T-bar grid so the T-bar grid fits the notch smoothly. There are two 4 foot L-bar grid moldings, one identified by number 25 in FIG. 1 and having one notch 59 in the center, and the second identified by number 26 in FIG. 1 and having two notches 59, 11.5 inches from each end to accommodate the standard T-bar grid placement. These two L-bar moldings eliminate the need for additional T joints and result in less cutting of the moldings during installation.

Figure 3:
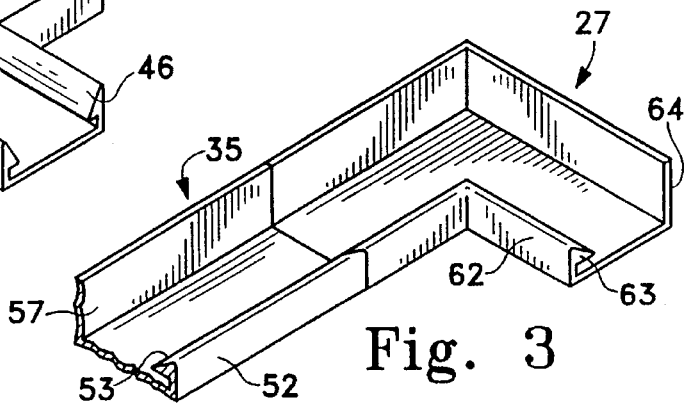
FIG. 3 is a perspective view of an L-bar molding and an adjacent inside corner molding in proper alignment.
Figure 4:
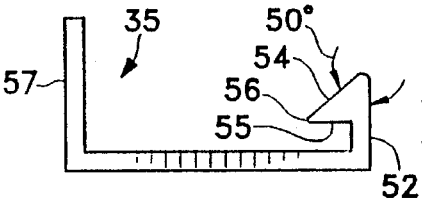
FIG. 4 is an end elevation of an L-bar molding showing the 50° angle of the upward facing surface of the return flange.
Figure 7:
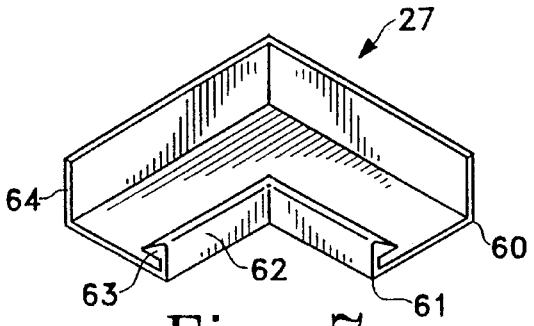
FIG. 7 is a perspective view of an inside corner molding.

To provide finished corners to the ceiling facing and to conform the system to most room configurations two corner moldings are provided. The inside corner molding 27 is L-shaped with two equivalent arms. (FIG. 7) There are two L-shaped edges, a long L-shaped edge 60 and a short L-shaped edge 61, and two transverse edges. Contiguous with the short L-shaped edge 61 is a vertical sidewall 62 with a return flange 63. This return flange 63 is the same as that of the L-bar moldings where the upward facing surface forms a 50° angle with the vertical sidewall. Contiguous with the long L-shaped edge 60 is a taller vertical sidewall 64 with no return flange. FIG. 3 shows an inside corner molding in contact alignment with an L-bar molding.

Figure 8:
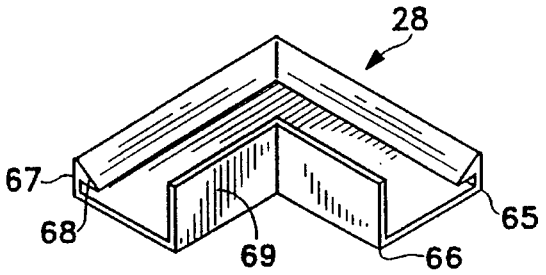
FIG. 8 is a perspective view of an outside corner molding.

The outside corner molding 28 is also L-shaped with two equivalent arms. (FIG. 8) There are two L-shaped edges, a long L-shaped edge 65 and a short L-shaped edge 66, and two transverse edges. Contiguous with the long L-shaped edge 65 is a vertical sidewall 67 with a return flange 68. The return flange 68 is the same as that of the L-bar moldings where the upward facing surface of the return flange forms a 50° angle with the vertical sidewall. Contiguous with the short L-shaped edge 66 is a taller vertical sidewall 69 with no return flange.

Both the inside corner molding 27 and the outside corner molding 28 are used against the walls of the room and are installed in the same manner as the L-bar moldings with the taller unflanged vertical walls of the moldings abutting the walls of the room.

Figure 12:
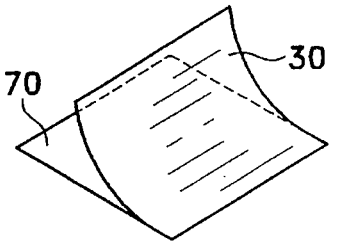
FIG. 12 is a perspective view of a facing cover for a 2'×2' ceiling tile and its backing sheet.
Figure 13:
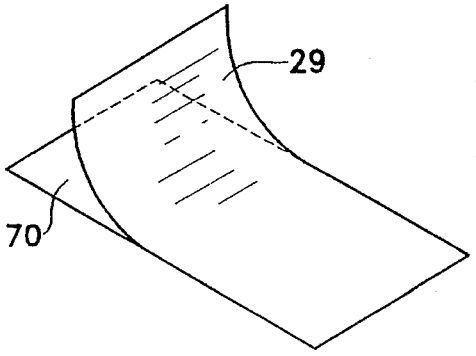
FIG. 13 perspective view of a facing cover for a 2'×4' ceiling tile and its backing sheet.
Figure 14:
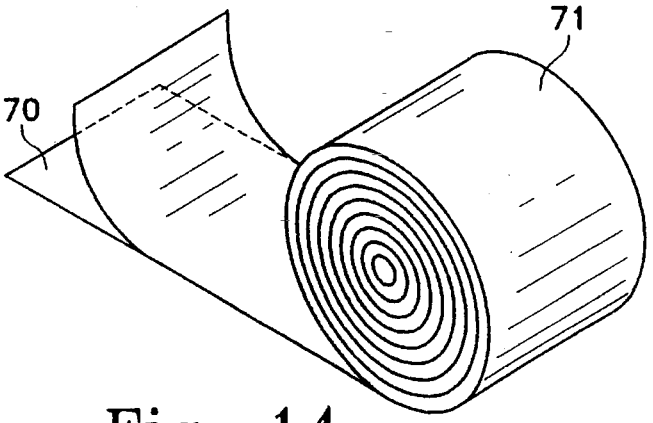
FIG. 14 is a perspectiver view of a 2' wide roll of ceiling tile facing with backing.
Figure 17A:
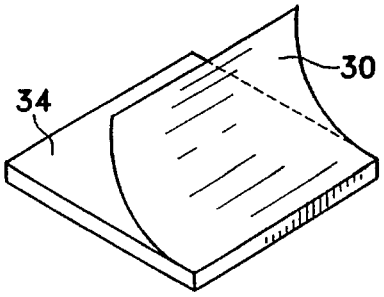
FIG. 17*a* is a perspective view of a 2'×2' ceiling tile showing the facing being applied.
Figure 17B:
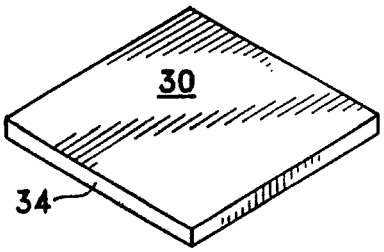
FIG. 17*b* is a perspective view of a 2'×2' ceiling tile showing the facing in place.

The ceiling panels are easily refaced by coveting their surfaces with a thin flexible sheet. This ceiling panel resurfacing provides a clean surface and can also provide a change of color or a new design or texture, but no appreciable weight is added to the panel. Ceiling panels come in two standard sizes, a 2'×2' ceiling panel 34 and a 2'×4' ceiling panel 33. To accommodate these two sizes, ready cut panel refacing sheets are provided, the 2'×2' ceiling panel facing 30 (FIG. 12) and the 2'×4' ceiling panel facing 29 (FIG. 13). These panel refacing sheets can be applied to the ceiling panels with any common adhesive, but to make the refacing as quick and easy as possible they can be manufactured with a pressure sensitive adhesive and a backing sheet 70 that is removed immediately prior to application. The only cutting necessary is for peripheral areas. The sheets can also be manufactured in long rolls 71 that are two feet wide, with the adhesive and backing sheet 70. (See FIG. 14) When the roll 71 is used, each sheet is cut to the length needed. To reface the ceiling panel it need only be removed and placed face up on a flat surface. The ceiling panel facing 30 is removed from the backing sheet 70 and applied to the ceiling panel 34 as in FIGS. 17*a–b*. The ceiling panel can thereafter be reinstalled. A heat sensitive adhesive can also be used.

The moldings of the present invention can be made of any lightweight flexible resilient material, preferably a polymeric material. The refacing sheets can also be made of polymeric material, but they can also be made of any cloth or of paper.

The actual dimensions of the various components are determined by the size and placement of the standard suspended ceiling grids and panels. The moldings are sized to fit their respective positions and lie contiguous to the adjacent moldings and in the same plane for a smooth, finished appearance. Typical dimensions of the components of the instant invention identified by their assigned parts numbers are as follows:

| | | |
|---|---|---|
| 21 | T-bar molding (4 ft) | 44.5 in |
| 22 | T-bar molding (2 ft) | 20.5 in |
| 23 | cross piece molding | 3.5 in × 3.5 in |
| 24 | T-piece molding | 3.5 in × 2.25 in |
| 25 | L-bar molding | 48 in 1 in center notch |
| 26 | L-bar molding | 48 in 1 in notces 11.5 in from each end |
| 27 | inside corner molding | 2.25 in on each long edge |
| 28 | outside corner molding | 2.25 in on each long edge |
| 29 | 4 × 2 ceiling panel facing | 47.75 in × 23.75 in |
| 30 | 2 × 2 ceiling panel facing | 23.75 in × 23.75 in |
| 71 | roll of panel facing | 23.75 in wide |

The exterior width of all moldings is one inch. The number of components of the present invention provides coverage of all existing grids and grid intersections of the standard suspended ceilings. Since the moldings adjacent the walls slip up behind the L-bar grids they lie closer to the walls than the unfaced grids and give a very finished appearance to the completed ceiling, much as wall moldings. The close linear abutment of the components due to precutting to size during manufacture help to maintain the proper perpendicular orientation and alignment of the suspended grids.

When large areas that open into other rooms are refaced, the planar nature of the refacing system ailows one room to be refaced when the adjoining room does not need refacing. There will be no drastic change in appearance, other then a clean look or new color. It is even possible to reface one area of the ceiling of a large room when there has been some ceiling damage, while leaving the rest of the ceiling alone.

In cases where the grids require refacing but the ceiling panels are not damaged it is possible to install the refacing moldings without even removing the panels. This can be done because the panels are not heavy and just rest on the grid flanges. The ceiling panels can be easily lifted up or shifted slightly from their seated positions, the moldings snapped into place, and the ceiling panels reseated. If the ceiling panels sustain damage and the grids are intact, only the ceiling panels can be refaced without refacing the grids.

The nature and design of the moldings permits them to be removed as easily as installed so that further refacings at a later time are just as easy to accomplish.

While one embodiment of the present invention has been illustrated and described in detail, it is to be understood that this invention is not limited thereto and may be otherwise practiced within the scope of the following claims.

I claim:

1. A method for installing a ceiling refacing system for a subceiling of a type having rectangular panels supported by a suspended framework of longitudinal grids and cooperating transverse grids, each being in the form of an inverted T-bar having horizontal flanges bisected by a vertical web, and peripheral grids each being in the form of an L-bar with a singular horizontal flange, wherein all exposed grid surfaces are covered thereby improving the appearance of said subceiling, said method comprising:

placing a plurality of mating members configured to cover the T-bar grids and the L-bar grids and the intersections of said grids, said mating members defining T-bar molding means for covering the longitudinal and transverse T-bar grids, cross piece molding means for covering the intersections of one of said longitudinal T-bar grids and two of said transverse T-bar grids, T-piece molding means for covering the intersection of one of said longitudinal T-bar grids with one of said transverse T-bar grids, L-bar molding means for covering the peripheral L-bar grids, and inside corner molding means and outside corner molding means for covering the intersections of the L-bar molding means at the corners of the room; the T-bar molding means being linear, the cross piece molding means being X-shaped with four equal arms radiating from a common point at right angles to each other, the T-piece molding means being T-shaped with three equal arms radiating from a common point, two of said arms being linearly configured and the third at right angles thereto; the T-bar molding means, cross piece molding means and T-piece molding means each having a flat base with an upper surface defining the interior base and an outer surface defining the exposed face, and opposing exterior edges; the T-bar molding means, and the arms of said cross piece molding means and T-piece molding means having opposing vertical side walls contiguous with said exterior edges, return flanges extending inwardly and disposed along the upper edge of each side wall and having an upward facing surface, a horizontal downward facing surface and an inward facing edge, said upward facing surfaces extending from the vertical sidewalls and forming acute angles therewith and said T-bar molding means and the arms of said cross piece molding means and said T-piece molding means being identical in transverse cross-section enabling intimate cooperation with each other when properly positioned; the L-bar molding means being linear, the inside corner molding means and the outside corner molding means being L-shaped with two equal arms radiating from a common point at right angles to each other, and each of said molding means having a flat base with an upper surface defining the interior base and a lower surface defining the exposed face, and opposing exterior edges; the L-bar molding means, the inside corner molding means and the outside corner molding means having two opposing vertical sidewalls contiguous with said exterior edges, one of said sidewalls being the taller sidewall and the other sidewall being the shorter sidewall, said shorter sidewall being away from the periphery of the room and having a return flange extending inwardly and disposed along its upper edge, said return flange having a upward facing surface, a horizontal downward facing surface and an inward facing edge, said upward facing surface extending from the vertical sidewall and forming an acute angle therewith and said L-bar molding means and the arms of said inside corner molding means and the arms of said outside corner molding means being identical in transverse cross-section enabling intimate cooperation when properly positioned and the L-bar molding means having notches in the shorter sidewalls spaced and shaped to coact with the ends of the T-bar molding means when properly positioned; all of said molding means being made of a flexible and resilient material;

properly positioning each mating member so that it lies contiguous to the adjacent mating member and in the same plane therewith;

cutting to proper proportions only those mating members that are needed to fit peripheral areas in the grid system;

properly positioning the cut mating members as needed such that they cleanly abut contiguous mating members and lie in the same plane therewith;

whereby said acute angles of the upward facing surfaces of the return flanges assist said mating members in sliding smoothly onto the grids by causing the vertical sidewalls of said mating members to be displaced outwardly by pressure from the flanges of the grids along the angled surfaces as the mating members are pressed upward against said grids, and the mating members are seated onto the grids with minimal upward force so as not to cause distortion or misalignment of said grids and thereafter each mating member lies flat against the grid and contiguous with the adjoining mating member providing an unbroken covering over the existing grids and a new and clean appearance to the subceiling.

2. A method for installing a ceiling refacing system for a subceiling of a type having rectangular panels supported by a suspended framework of longitudinal grids and cooperating transverse grids, each being in the form of an inverted T-bar having horizontal flanges bisected by a vertical web, and peripheral grids each being in the form of an L-bar with a singular horizontal flange, wherein all exposed grid surfaces are covered thereby improving the appearance of said subceiling, said method comprising:

placing a plurality of mating members configured to cover the T-bar grids and the L-bar grids and the intersections of said grids, said mating members defining T-bar molding means for covering the longitudinal and transverse T-bar grids, cross piece molding means for covering the intersections of one of said longitudinal T-bar grids and two of said transverse T-bar grids, T-piece molding means for covering the intersection of one of said longitudinal T-bar grids with one of said transverse T-bar grids, L-bar molding means for covering the peripheral L-bar grids, and inside corner molding means and outside corner molding means for covering the intersections of the L-bar molding means at the corners of the room; the T-bar molding means being linear, the cross piece molding means being X-shaped with four equal arms radiating from a common point at right angles to each other, the T-piece molding means being T-shaped with three equal arms radiating from a common point, two of said arms being linearly configured and the third at right angles thereto; the T-bar molding means, cross piece molding means and T-piece molding means each having a flat base with an upper surface defining the interior base and an outer surface defining the exposed face, and opposing exterior edges; the T-bar molding means, and the arms of said cross piece molding means and the T-piece molding means having opposing vertical side walls contiguous with said exterior edges, return flanges extending inwardly and disposed along the upper edge of each side wall and having an upward facing surface, a horizontal downward facing surface and an inward facing edge, said upward facing surfaces extending from the vertical sidewalls and forming acute angles therewith and said T-bar molding means and the arms of said cross piece molding means and said T-piece molding means being identical in transverse cross-section enabling intimate cooperation with each other when properly positioned; the L-bar molding means being linear, the inside corner molding means and the outside corner molding means being L-shaped with two equal arms radiating from a common point at right angles to each other, and each of said molding means having a flat base with an upper surface defining the interior base and a lower surface defining the exposed face, and opposing exterior edges; the L-bar molding means, the inside corner molding means and the outside corner molding means having two opposing vertical sidewalls contiguous with said exterior edges, one of said sidewalls being the taller sidewall and the other sidewall being the shorter sidewall, said shorter sidewall being away from the periphery of the room and having a return flange extending inwardly and disposed along its upper edge, said return flange having a upward facing surface, a horizontal downward facing surface and an inward facing edge, said upward facing surface extending from the vertical sidewall and forming an acute angle therewith and said L-bar molding means and the arms of said inside corner molding means and the arms of said outside corner molding means being identical in transverse cross-section enabling intimate cooperation when properly positioned and the L-bar molding means having notches in the shorter sidewalls spaced and shaped to coact with the ends of the T-bar molding means when properly positioned; all of said molding means being made of a flexible and resilient material;

properly positioning each mating member so that it lies contiguous to the adjacent mating member and in the same plane therewith;

cutting to proper proportions only those mating members that are needed to fit peripheral areas in the grid system;

properly positioning the cut mating members as needed such that they cleanly abut contiguous mating members and lie in the same plane therewith;

removing the rectangular panels;

applying pliable facing means to the exposed surfaces of the rectangular panels;

replacing the resurfaced rectangular panel to their former positions;

whereby said acute angles of the upward facing surfaces of the return flanges assist said mating members in sliding smoothly onto the grids by causing the vertical sidewalls of said mating members to be displaced outwardly by pressure from the flanges of the grids along the angled surfaces as the mating members are pressed upward against said grids, and the mating members are seated onto the grids with minimal upward force so as not to cause distortion or misalignment of said grids and thereafter each mating member lies flat against the grid and contiguous with the adjoining mating member resulting in an unbroken covering over the existing grids and the pliable facing means completely covers the exposed surfaces of the panels providing a new and clean appearance to the entire subceiling.

3. For a subceiling of a type having rectangular panels supported by a suspended framework of longitudinal grids and cooperating transverse grids, each being in the form of an inverted T-bar having horizontal flanges bisected by a vertical web, and peripheral grids each being in the form of an L-bar with a singular horizontal flange, a refacing system that completely covers all exposed grid surfaces by providing a new surface cover for said grids thereby improving the appearance of said subceiling, said refacing system comprising:

a plurality of mating members configured to cover the T-bar grids and the L-bar grids and the intersections of said grids, said mating members defining T-bar molding means for covering the longitudinal and transverse T-bar grids, cross piece molding means for covering the intersections of one of said longitudinal T-bar grids and two of said transverse T-bar grids, T-piece molding means for covering the intersection of one of said longitudinal T-bar grids with one of said transverse T-bar grids, L-bar molding means for covering the peripheral L-bar grids, and inside corner molding means and outside corner molding means for covering the intersections of the L-bar molding means at the corners of the room;

the T-bar molding means being linear, the cross piece molding means being X-shaped with four equal arms radiating from a common point at right angles to each other, the T-piece molding means being T-shaped with three equal arms radiating from a common point, two of said arms being linearly configured and the third at right angles thereto;

the T-bar molding means, cross piece molding means and T-piece molding means each having a flat base with an upper surface defining the interior base and an outer surface defining the exposed face, and opposing exterior edges;

the T-bar molding means, and the arms of said cross piece molding means and said T-piece molding means having opposing vertical side walls contiguous with said exterior edges, return flanges extending inwardly and disposed along the upper edge of each side wall and having an upward facing surface, a horizontal downward facing surface and an inward facing edge, said upward facing surfaces extending from the vertical sidewalls and forming acute angles therewith and said T-bar molding means and the arms of said cross piece molding means and said T-piece molding means being identical in transverse cross-section enabling intimate cooperation with each other when properly positioned;

the L-bar molding means being linear, the inside corner molding means and the outside corner molding means being L-shaped with two equal arms radiating from a common point at right angles to each other, and each of said molding means having a flat base with an upper surface defining the interior base and a lower surface defining the exposed face, and opposing exterior edges;

the L-bar molding means, the inside corner molding means and the outside corner molding means having two opposing vertical sidewalls contiguous with said exterior edges, one of said sidewalls being the taller sidewall and the other sidewall being the shorter sidewall, said shorter sidewall being away from the periphery of the room and having a return flange extending inwardly and disposed along its upper edge, said return flange having a upward facing surface, a horizontal downward facing surface and an inward facing edge, said upward facing surface extending from the vertical sidewall and forming an acute angle therewith and said L-bar molding means and the arms of said inside corner molding means and the arms of said outside corner molding means being identical in transverse cross-section enabling intimate cooperation when properly positioned and the L-bar molding means having notches in the shorter sidewalls spaced and shaped to coact with the ends of the T-bar molding means when properly positioned;

all of said mating members being made of a flexible and resilient material;

whereby said acute angles of the upward facing surfaces of the return flanges are oriented to assist said mating members in sliding smoothly onto the grids by causing the ranged vertical sidewalls of said mating members to be displaced outwardly by pressure from the flanges of the grids along the angled surface as the mating members are pressed upward against said grids during installation, and the mating members are capable of being seated onto the grids with minimal upward force so as not to cause distortion or misalignment of said grids and thereafter each mating member lies flat against the grid and contiguous with the adjoining mating member to provide an unbroken covering over the exposed surfaces of said grids resulting in a new and clean appearance to the subceiling.

4. For a subceiling of a type having rectangular panels supported by a suspended framework of longitudinal grids and cooperating transverse grids, each being in the form of an inverted T-bar having horizontal flanges bisected by a vertical web, and peripheral grids each being in the form of an L-bar with a singular horizontal flange, a refacing system that completely covers all exposed grid surfaces by providing a new surface cover for said grids thereby improving the appearance of said subceiling, said refacing system comprising:

a plurality of mating members configured to cover the T-bar grids and the L-bar grids and the intersections of said grids, said mating members defining T-bar molding means for covering the longitudinal and transverse T-bar grids, cross piece molding means for covering the intersections of one of said longitudinal T-bar grids and two of said transverse T-bar grids, T-piece molding means for covering the intersection of one of said longitudinal T-bar grids with one of said transverse T-bar grids, L-bar molding means for covering the peripheral L-bar grids, and inside corner molding means and outside corner molding means for covering the intersections of the L-bar molding means at the corners of the room;

the T-bar molding means being linear, the cross piece molding means being X-shaped with four equal arms radiating from a common point at right angles to each other, the T-piece molding means being T-shaped with three equal arms radiating from a common point, two of said arms being linearly configured and the third at right angles thereto;

the T-bar molding means, cross piece molding means and T-piece molding means each having a flat base with an upper surface defining the interior base and an outer surface defining the exposed face, and opposing exterior edges;

the T-bar molding means, and the arms of said cross piece molding means and said T-piece molding means having opposing vertical side walls contiguous with said exterior edges, return flanges extending inwardly and disposed along the upper edge of each side wall and having an upward facing surface, a horizontal downward facing surface and an inward facing edge, said upward facing surfaces extending from the vertical sidewalls and forming acute angles therewith and said T-bar molding means and the arms of said cross piece molding means and said T-piece molding means being identical in transverse cross-section enabling intimate cooperation with each other when properly positioned;

the L-bar molding means being linear, the inside corner molding means and the outside corner molding means being L-shaped with two equal arms radiating from a common point at right angles to each other, and each of said molding means having a flat base with an upper surface defining the interior base and a lower surface defining the exposed face, and opposing exterior edges;

the L-bar molding means, the inside corner molding means and the outside corner molding means having two opposing vertical sidewalls contiguous with said exterior edges, one of said sidewalls being the taller sidewall and the other sidewall being the shorter sidewall, said shorter sidewall being away from the periphery of the room and having a return flange extending inwardly and disposed along its upper edge, said return flange having a upward facing surface, a horizontal downward facing surface and an inward facing edge, said upward facing surface extending from the vertical sidewall and forming an acute angle therewith and said L-bar molding means and the arms of said inside corner molding means and the arms of said outside corner molding means being identical in transverse cross-section enabling intimate cooperation when properly positioned and the L-bar molding means having notches in the shorter sidewalls spaced and shaped coact with the ends of the T-bar molding means when properly positioned;

all of said mating members being made of a flexible and resilient material;

pliable facing means to be superimposed on said rectangular panels, said facing means being sheets of material sized to completely cover the exposed surfaces of said rectangular panels;

whereby said acute angles of the upward facing surfaces of the return flanges are oriented to assist said mating members in sliding smoothly onto the grids by causing the ranged vertical sidewalls of said mating members to be displaced outwardly by pressure from the flanges of the grids along the angled surface as the mating members are pressed upward against said grids during installation, and the mating members are capable of being seated onto the grids with minimal upward force so as not to cause distortion or misalignment of said grids and thereafter each mating member lies flat against the grid and contiguous with the adjoining mating member to provide an unbroken covering over the exposed surfaces of said grids and the pliable facing means covering the exposed surfaces of said rectangular panels resulting in a new and clean appearance to the subceiling.

* * * * *